US012071814B2

(12) United States Patent
Aidagulov et al.

(10) Patent No.: US 12,071,814 B2
(45) Date of Patent: Aug. 27, 2024

(54) WELLBORE NOTCHING ASSEMBLY

(71) Applicants: Saudi Arabian Oil Company, Dhahran (SA); Schlumberger Middle East, S.A., Dubai (AE)

(72) Inventors: Gallyam Aidagulov, Dhahran (SA); Devon Chikonga Gwaba, Kennesaw, GA (US); Abbad Mustapha, Khobar (SA); Khalid Mohammed M. Alruwaili, Dhahran (SA); Murtadha J. AlTammar, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/114,150

(22) Filed: Dec. 7, 2020

(65) Prior Publication Data

US 2022/0178208 A1 Jun. 9, 2022

(51) Int. Cl.
*E21B 10/32* (2006.01)

(52) U.S. Cl.
CPC ..... *E21B 10/327* (2013.01)

(58) Field of Classification Search
CPC ..... E21B 10/32; E21B 10/327; E21B 10/34
See application file for complete search history.

(56) References Cited

U.S. PATENT DOCUMENTS 84,852 A 12/1868 Beach
821,816 A 5/1906 Myrick
1,822,216 A * 9/1931 Hartson ..... E21B 10/32 175/286
2,324,956 A * 7/1943 Sewell ..... E21B 10/34 30/106

(Continued)

FOREIGN PATENT DOCUMENTS

CN 101726223 6/2010
CN 111894468 A * 11/2020 ..... E21B 10/32

(Continued)

OTHER PUBLICATIONS

PCT International Search Report and Written Opinion in International Appln. No. PCT/US2021/062119, dated Mar. 3, 2022, 14 pages.

(Continued)

*Primary Examiner* — Blake Michener
(74) *Attorney, Agent, or Firm* — Fish & Richardson P.C.

(57) ABSTRACT

A well tool for generating a notch in an open-hole wellbore, includes a tool body having a housing defining at least one slot and an interior volume. The tool body includes a cutting device disposed in the interior volume, configured to form a notch in a formation. The cutting device includes a shaft disposed in the interior volume of the housing having a first portion with a first exterior threads that extend around the first portion in a first direction, and a second portion having second exterior threads that extend around the second portion in a second direction opposite the first direction. The cutting device includes multiple blades configured to extend radially outward toward the formation through the slot or inward away from the formation and having a first blade extending from the first portion of the shaft and a second blade extending from a second portion of the shaft.

34 Claims, 8 Drawing Sheets

(56) References Cited

U.S. PATENT DOCUMENTS 2,372,875 A * 4/1945 Benke ..... E21B 49/06 173/19
2,450,223 A * 9/1948 Barbour ..... E21B 10/003 175/401
2,688,369 A 9/1954 Broyles
2,699,212 A 1/1955 Dismukes
2,758,653 A 8/1956 Desbrow
3,050,122 A 8/1962 Huitt et al.
3,118,501 A 1/1964 Kenley
3,211,221 A 10/1965 Huitt
3,254,720 A 8/1966 Huitt
3,313,348 A 4/1967 Huitt et al.
3,331,439 A 7/1967 Lawrence
3,379,266 A * 4/1968 Fletcher ..... E21B 10/32 175/285
3,599,734 A * 8/1971 Farris ..... E21B 43/112 175/173
4,189,184 A * 2/1980 Green ..... E21B 43/29 299/8
4,220,550 A 9/1980 Frenier et al.
4,262,745 A 4/1981 Stewart
4,270,618 A 6/1981 Owens
4,289,639 A 9/1981 Buske
4,381,950 A 5/1983 Lawson
4,390,067 A 6/1983 Willman
4,629,702 A 12/1986 Fan et al.
4,662,440 A 5/1987 Harmon
4,687,061 A 8/1987 Uhri
4,754,808 A 7/1988 Harmon
4,809,793 A 3/1989 Hailey
4,974,675 A 12/1990 Austin et al.
5,016,710 A 5/1991 Renard
5,060,738 A 10/1991 Pittard et al.
5,074,360 A 12/1991 Guinn
5,111,881 A 5/1992 Soliman et al.
5,228,510 A 7/1993 Jennings, Jr.
5,251,286 A 10/1993 Wiener et al.
5,277,062 A 1/1994 Blauch et al.
5,450,902 A 9/1995 Matthews
5,517,854 A 5/1996 Plumb et al.
5,735,359 A 4/1998 Lee et al.
5,853,054 A 12/1998 McGarian et al.
5,999,887 A 12/1999 Giannakopoulos et al.
6,070,677 A * 6/2000 Johnston, Jr. ..... E21B 47/095 175/325.1
6,095,244 A 8/2000 Graham
6,119,776 A 9/2000 Graham et al.
6,140,816 A 10/2000 Heron et al.
6,425,448 B1 7/2002 Zupanick
6,488,087 B2 12/2002 Longbottom
6,516,080 B1 2/2003 Nur
6,575,255 B1 * 6/2003 Rial ..... E21B 10/32 175/57
6,591,922 B1 * 7/2003 Rial ..... E21B 10/32 175/292
6,694,262 B2 2/2004 Rozak
6,729,394 B1 5/2004 Hassan
6,843,233 B2 1/2005 Berger et al.
6,866,048 B2 3/2005 Mattox
6,979,547 B2 * 12/2005 Huang ..... C07K 14/705 435/7.1
7,369,980 B2 5/2008 Deffenbaugh et al.
7,370,696 B2 5/2008 Al-Muraikhi
7,419,005 B2 9/2008 Al-Muraikhi
7,472,748 B2 1/2009 Gdanski et al.
7,637,316 B2 12/2009 Best
7,828,063 B2 11/2010 Olsen et al.
8,041,510 B2 10/2011 Dasgupta
8,081,802 B2 12/2011 Dvorkin et al.
8,265,915 B2 9/2012 Hsu et al.
8,380,437 B2 2/2013 Abousleiman et al.
8,490,685 B2 7/2013 Tolman
8,606,524 B2 12/2013 Soliman et al.
8,614,573 B2 12/2013 Minh
8,631,872 B2 1/2014 East
8,731,889 B2 5/2014 Du et al.
8,868,385 B2 10/2014 Fertig et al.
8,967,249 B2 3/2015 Akkurt et al.
9,046,509 B2 6/2015 Dvorkin et al.
9,063,252 B2 6/2015 Kamal
9,097,818 B2 8/2015 Hursan
9,187,992 B2 11/2015 Cherian
9,784,085 B2 10/2017 Liu et al.
10,351,758 B2 7/2019 Hull et al.
10,415,367 B2 9/2019 Galford
10,612,355 B1 4/2020 Alruwaili et al.
2005/0060130 A1 3/2005 Shapiro et al.
2007/0051517 A1 3/2007 Surjaatmadja et al.
2007/0203677 A1 8/2007 Awwiller
2008/0179060 A1 7/2008 Surjaatmadja et al.
2008/0264640 A1 10/2008 Eslinger
2009/0193881 A1 8/2009 Finnberg
2009/0266548 A1 10/2009 Olsen et al.
2010/0128982 A1 5/2010 Dvorkin et al.
2010/0186520 A1 7/2010 Wheeler
2010/0213579 A1 8/2010 Henry
2010/0279136 A1 11/2010 Bonucci
2010/0282511 A1 * 11/2010 Maranuk ..... E21B 10/322 175/344
2011/0017458 A1 1/2011 East et al.
2011/0067870 A1 3/2011 East
2011/0284214 A1 11/2011 Ayoub et al.
2012/0150515 A1 6/2012 Hariharan et al.
2013/0032349 A1 2/2013 Alekseenko et al.
2013/0199787 A1 8/2013 Dale et al.
2013/0248192 A1 9/2013 Cook
2014/0048694 A1 2/2014 Pomerantz
2014/0069653 A1 3/2014 Liu et al.
2014/0078288 A1 3/2014 Wu
2014/0352968 A1 12/2014 Pitcher
2015/0096806 A1 4/2015 Fonseca Ocampos
2015/0136388 A1 5/2015 Fehr et al.
2015/0176362 A1 6/2015 Hariharan et al.
2015/0293256 A1 10/2015 Dusterhoft
2016/0201440 A1 7/2016 Aidagulov
2016/0203239 A1 7/2016 Samuel et al.
2017/0030188 A1 2/2017 Lehr
2017/0067836 A1 3/2017 Hull et al.
2017/0176639 A1 6/2017 Mosse et al.
2017/0248011 A1 8/2017 Craddock et al.
2018/0119533 A1 5/2018 Alhuthali
2018/0119535 A1 5/2018 Shen et al.
2018/0266183 A1 9/2018 Ayub
2018/0321416 A1 11/2018 Freedman
2018/0371903 A1 12/2018 Li et al.
2019/0112912 A1 4/2019 Thompson et al.
2019/0195043 A1 6/2019 Singh
2019/0218907 A1 7/2019 Ow
2019/0226956 A1 7/2019 Alruwaili et al.
2020/0024935 A1 1/2020 Eitschberger et al.
2020/0024936 A1 1/2020 Chang
2022/0042409 A1 * 2/2022 Sidaoui ..... E21B 43/27

FOREIGN PATENT DOCUMENTS

EA 004186 2/2004
EP 0460927 2/1993
EP 0474350 9/1994
GB 2172632 9/1986
RU 2211318 8/2003
SU 1036926 8/1983
SU 1680925 9/1991
SU 1709055 1/1992
WO WO 2010008684 1/2010
WO WO 2010074581 7/2010
WO WO 2010083166 7/2010
WO WO 2014116305 7/2014
WO WO 2014178504 11/2014
WO WO 2016094153 6/2016
WO WO 2017065331 4/2017
WO WO 2017078674 5/2017

(56) References Cited

FOREIGN PATENT DOCUMENTS

| | | |
|---|---|---|
| WO | WO 2018174987 | 9/2018 |
| WO | WO 2018175394 | 9/2018 |
| WO | WO 2019064041 | 4/2019 |

OTHER PUBLICATIONS

Abad et al., "Evaluation of the Material Properties of the Multilayered Oxides formed on HCM12A using New and Novel Techniques," Manuscript No. OXID-D-15-00019, Manuscript Draft, 2015, 44 pages.
Abousleiman et al., "A Micromechanically Consistent Poroviscoelasticity Theory for Rock Mechanics Applications," International Journal of Rock Mechanics and Mining Services & Geomechanics, Abstracts, 1993, 30:7 (1177-1180), 4 pages.
Abousleiman et al., "Anisotropic Porothermoelastic Solution and Hydro-Thermal Effects on Fracture Width in Hydraulic Fracturing," International Journal for Numerical and Analytical Methods in Geomechanics, 2013, 25 pages.
Abousleiman et al., "GeoGenome Industry Consortium (G2IC)," JIP, 2004-2006, 6 pages.
Abousleiman et al., "Geomechanics Field and Laboratory Characterization of Woodford Shale: The Next Gas Play," SPE 110120, Society of Petroleum Engineers (SPE), presented at the 2007 SPE Annual Technical Conference and Exhibition on Nov. 11-14, 2007, 14 pages.
Abousleiman et al., "Geomechanics Field Characterization of the Two Prolific U.S. Mid-West Gas Plays with Advanced Wire-Line Logging Tools," SPE 124428, Society of Petroleum Engineers (SPE), presented at 2009 SPE Annual Technical Conference and Exhibition, Oct. 4-7, 2009, 19 pages.
Abousleiman et al., "Mandel's Problem Revisited," Geotechnique, 1996, 46:2 (187-195), 9 pages.
Abousleiman et al., "Mechanical Characterization of Small Shale Samples subjected to Fluid Exposure using the Inclined Direct Shear Testing Device," International Journal of Rock Mechanics and Mining Sciences, 2010, 47:3 (355-367), 13 pages.
Abousleiman et al., "Poroelastic Solutions in Transversely Isotropic Media for Wellbore and Cylinder," PPI: S0020-7683(98)00101-2, International Journal of Solids Structures, 1998, 35:34-35 (4905-4929), 25 pages.
Abousleiman et al., "Poroviscoelastic Analysis of Borehole and Cylinder Problems," ACTA Mechanica, 1996, 119: 199-219, 21 pages.
Abousleiman et al., "The Granular and Polymer Nature of Kerogen Rich Shale," Acta Geotechnica, Feb. 2016, 24 pages.
Aidagulov et al., "Model of Hydraulic Fracture Initiation from the Notched Open hole," SPE-178027-MS, Society of Petroleum Engineers (SPE), presented at the SPE Saudi Arabia Section Annual Technical Symposium and Exhibition, Apr. 21-23, 2015, 13 pages.
Aidagulov et al., "Notching as a New Promising Well Intervention Technique to Control Hydraulic Fracturing in Horizontal Open Holes," AAPG Datapages/Search and Discovery Article #90254, American Association of Petroleum Geologists (AAPG), presented at the 12th Middle East Geosciences Conference and Exhibition GEO-2016, Mar. 7-10, 2016.
Allan et al., "A Multiscale Methodology for the Analysis of Velocity Anisotropy in Organic-Rich Shale," Geophysics, Jul.-Aug. 2015, 80:4 (C73-C88), 16 pages.
Al-Qahtani et al., "A Semi-Analytical Model for Extended-Reach Wells with Wellbore Flow Splitting; a Production Optimization Scheme," SPE-177931, Society of Petroleum Engineers (SPE), presented at the Abu Dhabi International Petroleum Exhibition and Conference, Nov. 9-12, 2015, 21 pages.
Al-Yami et al., "Engineered Fit-for-Purpose Cement System to Withstand Life-of-the-Well Pressure and Temperature Cycling," SPE-188488-MS, Society of Petroleum Engineers (SPE), presented at the Abu Dhabi International Petroleum Exhibition & Conference, Nov. 2017, 14 pages.
Ananthan et al., "Influence of Strain Softening on the Fracture of Plain Concrete Beams," International Journal of Fracture, 1990, 45: 195-219, 25 pages.
Apageo.com [online], "Ménard Pressuremeter Pressuremeter test according," 2016, retrieved on Oct. 7, 2019, retrieved from URL <https://www.apageo.com/en/3/products%2Cpressuremeter-tests%2Cmenard-pressuremeter%2C14%2C5.html>, 2 pages.
Arns et al., "Computation of linear elastic properties from microtomographic images: Methodology and agreement between theory and experiment," Geophysics, Sep.-Oct. 2002, 67:5 (1396-1405), 10 pages.
Azizi et al, "Design of Deep Foundations Using the Pressuremeter Method," Proceedings of the Sixth International Offshore and Polar Engineering Conference, Los Angeles, May 1996, The International Offshore and Polar Engineers, 1, 9 pages.
Ballice, "Solvent Swelling Studies of Goynuk (Kerogen Type-I) and Beypazari Oil Shales (Kerogen Type-II)," Science Direct, Fuel, 2003, 82: 1317-1321, 5 pages.
Bazant et al., "Deformation of Progressively Cracking Reinforced Concrete Beams," Title No. 81-26, ACI Journal, Technical Paper, May-Jun. 1984, 81:3, 11 pages.
Bazant et al., "Strain-Softening Bar and Beam: Exact Non-Local Solution," International Journal of Solids Structures, 1988, 24:7 (659-673), 15 pages.
Benafan et al., "Shape Memory Alloy Rock Splitters (SMARS)—A Non-Explosive Method for Fracturing Planetary Rocklike Materials and Minerals," NASA/TM—2015-218832, NASA STI Program, Jul. 2015, 42 pages.
Bennett et al., "Instrumented Nanoindentation and 3D Mechanistic Modeling of a Shale at Multiple Scales," Acta Geotechnica, Jan. 2015, 10:21, 14 pages.
Berger et al., "Effect of eccentricity, voids, cement channels, and pore pressure decline on collapse resistance of casing," SPE-90045-MS, Society of Petroleum Engineers (SPE), presented at the SPE Annual Technical Conference and Exhibition, Sep. 26-29, 2004, 8 pages.
Bhandari et al., "Two-Dimensional DEM Analysis of Behavior of Geogrid-Reinforced Uniform Granular Bases under a Vertical Cyclic Load," Acta Geotechnica 10:469-480, 2014, 12 pages.
Biot, "General Theory of Three-Dimensional Consolidation," The Ernest Kempton Adams Fund for Physical Research of Columbia University, Reprint Series, Journal of Applied Physics, Feb. 1941, 12:2, 11 pages.
Bobko et al., "The Nanogranular Origin of Friction and Cohesion in Shale—A Strength Homogenization Approach to Interpretation of Nanoindentation Results," International Journal for Numerical Analytical Method in Geomechanics, 2010, 23 pages.
Boskey et al., "Perspective—Collagen and Bone Strength," Journal of Bone and Mineral Research, 1999, 14:3, 6 pages.
Bourbie and Zinszner, "Hydraulic and Acoustic Properties as a Function of Porosity in Fontainebleau Sandstone," Journal of Geophysical Research, 90:B13 (11524-11532), Nov. 1985, 9 pages.
Cai et al., "Experimental Investigation on Perforation of Shale with Ultra-High Pressure Abrasive Water Jet: Spake, Mechanism and Sensitivity," Journal of Natural Gas Science and Engineering, Jul. 2019, 67: 196-213, 18 pages.
Chang et al, "Multiple Fracture Initiation in Openhole without Mechanical Isolation: First Step to Fulfill an Ambition," SPE 168638, Society of Petroleum Engineers (SPE), presented at the SPE Hydraulic Fracturing Technology Conference, Feb. 4-6, 2014, 18 pages.
Chen et al., "Size Effect in Micro-Scale Cantilever Beam Bending," Acta Mech., 2011, 219: 291-307, 17 pages.
Chern et al., "Deformation of Progressively Cracking Partially Prestressed Concrete Beams," PCI Journal, Jan.-Feb. 1992, 37:1, 11 pages.
Chupin et al., "Finite Strain Analysis of Nonuniform Deformation Inside Shear Bands in Sands," International Journal for Numerical and Analytical Methods in Geomechanics, 2012, 36: 1651-1666, 16 pages.
Deirieh et al., "Nanochemomechanical Assessment of Shale: A Coupled WDS-Indentation Analysis," Acta Geotechnica, 2012, 25 pages.

(56) References Cited

OTHER PUBLICATIONS

Devarapalli et al., "Micro-CT and FIB-SEM imaging and pour structure characterization of dolomite rock at multiple scales," Arabian Journal of Geosciences, Aug. 2017, 9 pages, abstract only.
Dvorkin, "Kozeny-Carman Equation Revisited," 2009, 16 pages.
Ekbote et al., "Porochemoelastic Solution for an Included Borehole in a Transversely Isotropic Formation," Journal of Engineering Mechanics, ASCE, Jul. 2006, 10 pages.
Ertas et al., "Petroleum Expulsion Part 1. Theory of Kerogen Swelling in Multicomponent Solvents," Energy & Fuels, 2006, 20: 295-300, 6 pages.
Ewy, "Shale Swelling/Shrinkage and Water Content Change due to Imposed Suction and Due to Direct Brine Contact," Acta Geotechnica, 2014, 9: 869-886, 18 pages.
Finney, "Random packings and the structure of simple liquids I. The geometry of random close packing," Proceedings of the Royal Society A, May 1970, 319: 479-493, 15 pages.
Frazer et al., "Localized Mechanical Property Assessment of SiC/SiC Composite Materials," Science Direct, Composites: Part A, 2015, 70: 93-101, 9 pages.
Gao et al., "Materials Become Insensitive to Flaws at Nanoscale: Lessons from Nature," Proceedings of the National Academy of Sciences, PNAS, May 2003, 100:10 (5597-55600), 4 pages.
Garnero, "The Contribution of Collagen Crosslinks to Bone Strength," International Bone & Mineral Society, BoneKEy Reports, Sep. 2012, 1: 182, 8 pages.
Georgi et al., "Physics and Chemistry in Nanoscale Rocks," Society of Petroleum Engineers (SPE), SPE Forum Series, Frontier of Technology, Mar. 22-26, 2015, La Jolla, California, USA, 4 pages.
Goodman, "Chapter 3: Rock Strength and Failure Criteria," in Introduction to Rock Mechanics, John Wiley & Sons, 21 pages.
Han et al., "Impact of Depletion on Integrity of Sand Screen in Depleted Unconsolidated Sandstone Formation," ARMA-2015-301, American Rock Mechanics Association, (ARMA), presented in the 49th US Rock Mechanics/Geomechanics Symposium. American Rock Mechanics Association, Jun.-Jul. 2015, 9 pages.
Han et al., "LBM-DEM Modeling of Fluid-Solid Interaction in Porous Media," International Journal for Numerical and Analytical Methods in Geomechanics, 2013, 37: 1391-1407, 17 pages.
Han et al., "Numerical Modeling of Elastic Hemispherical Contact for Mohr-Coulomb Type Failures in Micro-Geomaterials," Experimental Mechanics, Jun. 2017, 57: 1091-1105, 14 pages.
Hay, "Development of an Insitu Rock Shear Testing Device," Dissertation for the Degree of Doctor of Philosophy, University of Florida, Graduate School, 2007, 67 pages.
Hirata et al., "Estimation of Damaged Region Around a Tunnel by Compact VSP Probe Using Super Elastic Alloy," 9th IRSM Congress, International Society for Rock Mechanics, Jan. 1999, 4 pages.
Hoang et al., "Correspondence Principle Between Anisotropic Poroviscoelasticity and Poroelasticity using Micromechanics and Application to Compression of Orthotropic Rectangular Strips," Journal of Applied Physics, American Institute of Physics, Aug. 2012, 112:044907, 16 pages.
Hornby et al., "Anisotropic Effective-Medium Modeling of the Elastic Properties of Shales," Geophysics, Oct. 1994, 59:10 (1570-1583), 14 pages.
Hosemann et al., "An Exploratory Study to Determine Applicability of Nano-Hardness and Micro-compression Measurements for Yield Stress Estimation," Science Direct, Journal of Nuclear Materials, 2008, 375: 135-143, 9 pages.
Hosemann et al., "Mechanical Characteristics of SiC Coating Layer in TRISO Fuel Particles," Journal of Nuclear Materials, 2013, 442: 133-142, 10 pages.
Huang et al., "A theoretical study of the critical external pressure for casing collapse" Journal of Natural Gas Science and Engineering, Nov. 2015, 27:1 (1-8), 8 pages.
Huang et al., "Collapse strength analysis of casing design using finite element method," International Journal of Pressure Vessels and Piping 2000, 77:359-367, 8 pages.
Huang et al., "Pressuremeter Tests in Poorly Cemented Weak Rocks," Rock Mechanics for Industry, Amadei, Kranz, Scott and Smealtie (eds), 1999, 6 pages.
Hull et al., "Oxidative Kerogen Degradation: A Potential Approach to Hydraulic Fracturing in Unconventionals," Energy Fuels 2019, 33:6 (4758-4766), 9 pages.
Inaba et al., "Static Rock Splitter Using Shape Memory Alloy as Pressure Source," Journal of Mining and Materials Processing Institute of Japan, Jan. 1991, 4 pages.
Iqbal et al., "In situ micro-cantilver tests to study fracture properties of NiAl single crystals," Acta Materialia, Feb. 2012, 60:3 (1193-1200), 8 pages.
Itasca, "Fast Lagrangian Analysis of Continua," Version 7.0. Minneapolis, Minnesota, 2011, 22 pages.
Itascag.com [online], "Three-dimensional Fast Lagrangian Analysis of Continua (FLAC3D)," available on or before 2012, [retrieved on Jun. 7, 2018], retrieved from URL: <https://www.itascacg.com/software/flac3d>, 4 pages.
Iyengar et al., "Analysis of Crack Propagation in Strain-Softening Beams," Engineering Fracture Mechanics, 2002, 69: 761-778, 18 pages.
Jose et al., "Continuous multi cycle nanoindentation studies on compositionally graded $Ti_{1-x}Al_xN$ multilayer thin films," Materials Science and Engineering: A, Elsevier, Apr. 20, 2011, 528:21 (6438-6444), 7 pages.
Kelemen et al., "Petroleum Expulsion Part 2. Organic Matter Type and Maturity Effects on Kerogen Swelling by Solvents and Thermodynamic Parameters for Kerogen from Regular Solution Theory," Energy & Fuels, 2006, 20: 301-308, 8 pages.
Kolymbas, "Kinematics of Shear Bands," Acta Geotechnica, 2009, 4: 315-318, 4 pages.
Lam et al., "Experiments and Theory in Strain Gradient Elasticity," Journal of Mechanics and Physics of Solids, 2003, 51: 1477-1508, 32 pages.
Larsen et al., "Changes in the Cross-Link Density of Paris Basin Toarcian Kerogen During Maturation," Organic Geochemistry, 2002, 33:1143-1152, 10 pages.
Lee et al., "An Analytical Study on Casing Design for Stabilization of Geothermal Well," Korean J. Air-Conditioning and Ref. Eng., 2012, 11:24, 16 pages.
L'homme, "Initiation of hydraulic fractures in natural sandstones," Master of Science in Geomechanics, University of Minnesota, PhD dissertation, Delft University of Technology, Delft, 2005, 281 pages.
Li et al., "Mechanical Characterization of Micro/Nanoscale Structures for MEMS/NEMS Applications using Nanoindentation Techniques," Science Direct, Ultramicroscopy, 2003, 97:481-494, 14 pages.
Liu, "Dimension effect on mechanical behavior of silicon micro-cantilver beams," Measurement, Oct. 2008, 41:8 (885-895), 11 pages.
Liu, "Micro-cantilver Testing to Evaluate the Mechanical Properties of Thermal Barrier Coatings," 19th European Conference on Fracture (ECF19): Fracture Mechanics for Durability, Reliability and Safety; Conference Proceedings held Aug. 26-31, 2012, Kazan, Russia, 7 pages.
Mahabadi et al., "A novel approach for micro-scale characterization and modeling of geomaterials incorporating actual material heterogeneity," Geophysical Research Letters, American Geophysical Union, Jan. 1, 2012, 39: L01303, 6 pages.
Mahabadi et al., "Development of a new fully-parallel finite-discrete element code: Irazu," ARMA-2016-516, American Rock Mechanics Association (ARMA), presented at the 50th US Rock Mechanics/Geomechanics Symposium, Jun. 26-29, 2016, 9 pages.
Mahmoud et al., "Removal of Pyrite and Different Types of Iron Sulfide Scales in Oil and Gas Wells without H2S Generation," IPTC-18279-MS, International Petroleum Technology Conference (IPTC), presented at the International Petroleum Technology Conference, Doha, Qatar, Dec. 6-9, 2015, 8 pages.
Maio et al., "Measuring Fracture Toughness of Coatings using Focused-ion-beam-machined Microbeams," Journal of Materials Research, Feb. 2005, 20:2, 4 pages.

(56) References Cited

OTHER PUBLICATIONS

Medlin et al., "Laboratory investigation of Fracture Initiation and Orientation," SPE-6087-PA, Society of Petroleum Engineers (SPE), Society of Petroleum Engineers Journal, Apr. 1976, 19:02, 16 pages.
Mitchell et al., "Chapter 7—Casing and Tubing Design," Properties of Casing and Tubing, Petroleum well construction, 1998, 40 pages.
Mohammed et al., "Casing structural integrity and failure modes in a range of well types—A review," Journal of Natural Gas Science and Engineering, 2019, 68: 102898, 25 pages.
Okiongbo et al., "Changes in Type II Kerogen Density as a Function of Maturity: Evidence from the Kimmeridge Clay Formation," Energy Fuels, 2005, 19: 2495-2499, 5 pages.
Oliver, "An Improved Technique for Determining Hardness and Elastic Modulus using Load and Displacement Sensing Indentation Experiments," Journal of Materials Research, Jun. 1992, 7:6, 20 pages.
Ortega et al., "The Effect of Particle Shape and Grain-Scale Properties of Shale: A Micromechanics Approach," International Journal for Numerical and Analytical Methods in Geomechanics, 2010, 34: 1124-1156, 33 pages.
Ortega et al., "The Effect of the Nanogranular Nature of Shale on their Poroelastic Behavior," Acta Geotechnica, 2007, 2: 155-182, 28 pages.
Ortega et al., "The Nanogranular Acoustic Signature of Shale," Geophysics, May-Jun. 2009, 74:3 (D65-D84), 20 pages.
Passey et al., "From Oil-Prone Source Rock to Gas-Producing Shale Reservoir—Geologic and Petrophysical Characterization of Unconventional Shale-Gas Reservoirs," SPE-131350, Society of Petroleum Engineers (SPE), presented at the CPS/SPE International Oil & Gas Conference and Exhibition, Beijing, China, Jun. 8-10, 2010, 29 pages.
Pittman, "Investigation of Abrasive-Laden-Fluid Method for Perforation and Fracture Initiation," SPE 1607-G, Society of Petroleum Engineers (SPE), presented at the 31st Annual California Regional Fall Meeting of SPE, Oct. 20-21, 1960, Journal of Petroleum Technology, May 1961, 13:5 (489-495), 7 pages.
Podio et al., "Dynamic Properties of Dry and Water-Saturated Green River Shale under Stress," SPE 1825, Society of Petroleum Engineers (SPE), presented at SPE 42nd Annual Fall Meeting, Oct. 1-4, 1967, Society of Petroleum Engineers Journal, Jun. 1968, 16 pages.
Poon et al., "An Analysis of Nanoindentation in Linearly Elastic Solids," International Journal of Solids and Structures, Dec. 2008, 45:24 (6018-6033), 16 pages.
Richard et al, "Slow Relaxation and Compaction of Granular Systems," Nature Materials, Feb. 2005, 4, 8 pages.
Shi et al., "Research and Application of Drilling Technology of Extended-reach Horizontally-intersected Well Used to Extract Coalbed Methane," 2011 Xi'an International Conference on Fine Geological Exploration and Groundwater & Gas Hazards Control in Coal Mines, Procedia Earth and Panetary Science, Dec. 2011, 3: 446-454, 9 pages.
Shin et al., "Development and Testing of Microcompression for Post Irradiation Characterization of ODS Steels," Journal of Nuclear Materials, 2014, 444: 43-48, 6 pages.
Sierra et al., "Woodford Shale Mechanical Properties and the Impacts of Lithofacies," ARMA 10-461, American Rock Mechanics Association (ARMA), presented at the 44th US Rock Mechanics Symposium and 5th US-Canada Rock mechanics Symposium, Jun. 27-30, 2010, 10 pages.
Slatt et al., "Merging Sequence Stratigraphy and Geomechanics for Unconventional Gas Shales," The Leading Edge, Special Section: Shales, Mar. 2011, 8 pages.
Slatt et al., "Outcrop/Behind Outcrop (Quarry), Multiscale Characterization of the Woodford Gas Shale," Chapter 12 in Shale-Reservoirs—Giant Resources for the 21st Century: AAPG Memoir, 2011, 97: 1-21, 22 pages.
Sone et al., "Mechanical Properties of Shale-Gas Reservoir Rocks—Part 1: Static and Dynamic Elastic Properties and Anisotropy," Geophysics, Sep.-Oct. 2013, 78:5 (D381-D392), 12 pages.
Sone et al., "Mechanical Properties of Shale-Gas Reservoir Rocks—Part 2: Ductile Creep, Brittle Strength, and their Relation to the Elastic Modulus," Geophysics, Sep.-Oct. 2013, 78:5 (D393-D402), 10 pages.
Ulm et al., "Material Invariant Poromechanics Properties of Shales," Poromechanics III: Biot Centennial, Proceedings of the 3rd Biot Conference on Poromechanics, 2005, 8 pages.
Ulm et al., "The Nanogranular Nature of Shale," Acta Geotechnica, 2006, 12 pages.
Vanlandingham, "Review of Instrumented Indentation," Journal of Research of the National Institute of Standards and Technology, Jul.-Aug. 2003, 108:4 (249-265), 17 pages.
Vernik et al., "Ultrasonic Velocity and Anisotropy of Hydrocarbon Source Rocks," Geophysics, May 1992, 57:5 (727-735), 9 pages.
Wang et al., "A Numerical Study of Factors Affecting the Characterization of Nanoindentation on Silicon," Materials Science and Engineering: A, Feb. 25, 2007, 447:1 (244-253), 10 pages.
Wang et al., "Iron Sulfide Scale Dissolvers: How Effective Are They?" SPE-168063-MS, Society of Petroleum Engineers (SPE), presented at the SPE Saudi Arabia section Annual Technical Symposium and Exhibition, Khobar, Saudi Arabia, May 19-22, 2013, 22 pages.
Wenk et al., "Preferred Orientation and Elastic Anisotropy of Illite-Rich Shale," Geophysics, Mar.-Apr. 2007, 72:2 (E69-E75), 7 pages.
Wilson et al., "Fracture testing of bulk silicon microcantilever beams subjected to a side load," Journal of Microelectromechanical Systems, Sep. 1996, 5:3, 9 pages.
Winkler et al, "Effects of borehole stress concentrations on dipole anisotropy measurements," Geophysics, Jan. 1998, 63:1 (11-17), 7 pages.
Wurster et al., "Characterization of the fracture toughness of microsized tungsten single crystal notched specimens," Philosophical Magazine, May 2012, 92:14, 23 pages.
Xi et al., "Uncertainty Analysis Method for Intersecting Process of U-Shaped Horizontal Wells," Arabian Journal for Science and Engineering, 40:2 (615-625), Feb. 2015, 12 pages.
Zeszotarski et al., "Imaging and Mechanical Property Measurements of Kerogen via Nanoindentation," Geochimica et Cosmochimica Acta, 2004, 68:20, 7 pages.
Zwanenburg et al., "Well Abandonment: Abrasive Jetting to Access a Poorly Cemented Annulus and Placing a Sealant," SPE-159216-MS, Society of Petroleum Engineers (SPE), presented at the SPE Annual Technical Conference and Exhibition, Oct. 8-10, 2012, 11 pages.

* cited by examiner

WELLBORE NOTCHING ASSEMBLY

TECHNICAL FIELD

This disclosure relates to a wellbore tool, a notching system, and a method for producing a notch in an open-hole wellbore.

BACKGROUND

To improve productivity of oil and gas wells, hydraulic fracturing is used to enhance connectivity between hydrocarbon-bearing reservoir formations and wellbores. In many cases, in tight formations without fractures, flow of hydrocarbons from reservoir formations towards wellbores is difficult to achieve and sustain at required levels. Such formations often include tight sandstones, tight carbonates, and shale. Hydraulic fractures can be created in vertical and horizontal wells both in cased-perforated and open-hole well completions.

SUMMARY

In certain aspects, a well tool for generating a notch in an open-hole wellbore, includes a tool body. The tool body has a housing defining at least one slot. The housing defines an interior volume. The tool body further includes a cutting device disposed in the interior volume of the housing and configured to form a notch in a formation through which the wellbore is formed. The cutting device has a shaft disposed in the interior volume of the housing. The shaft has a first portion having first exterior threads that extend around the first portion in a first direction, and a second portion having second exterior threads that extend around the second portion in a second direction opposite the first direction. The cutting device also includes multiple blades having a first blade extending from the first portion of the shaft and a second blade extending from a second portion of the shaft. The first and second blade are attached. The multiple blades are configured to extend radially outward toward the formation through the slot or inward away from the formation.

In some embodiments, the multiple blades extend radially outward toward the formation through the slot or inward away from the formation.

In some embodiments, the cutting device further comprises a first nut having a first threaded surface defining a first opening, wherein the first opening receives the first portion of the shaft. In some embodiments, the cutting device further includes a second nut having a second threaded surface defining a second opening, wherein the second opening receives the second portion of the shaft.

In some embodiments, the well tool has an extended position and a retracted position. In the extended position, multiple blades extend through the slot of the housing. In the retracted position the multiple blades are arranged in the interior volume of the housing. In some embodiments, the blade abuts the formation in the extended position.

In some embodiments, the first blade attaches at a first end to the first portion of the shaft and the second blade attaches at a first end to the second portion of the shaft, wherein a second end of the first blade and a second end of the second blade attach at a blade hinge. In some embodiments, a first nut connects the first end of the first blade to the first portion of the shaft. In some embodiments, a second nut connects the first end of the second blade to the second portion of the shaft.

In some embodiments, a blade hinge connects the first blade and the second blade. In some embodiments, the well tool further includes a scribe connected to the blade hinge of the cutting device. In some embodiments, the shaft defines a longitudinal axis, wherein the scribe is centered on and extends along a second axis, orthogonal to the longitudinal axis. In some embodiments, the scribe is configured to rotate on the second axis.

In some embodiments, at least one slot is multiple slots, each slot aligned with the first blade and second blade of the multiple blades.

In some embodiments, the well tool further includes a first motor connected to the tool body operable to rotate the tool body. In some embodiments, the well tool further includes a second motor connected to the shaft operable to rotate the shaft. In some embodiments, the first motor is connected to the shaft and is operable to rotate the shaft.

In some embodiments, the well tool further includes a first motor connected to the shaft operable to rotate the shaft. In some embodiments, a first nut arranged on the first portion of the shaft comprises a first lock and a second nut arranged on the second portion of the shaft comprises a second lock.

In some embodiments, the first portion of the shaft is rotatable relative to the second portion of the shaft. In some embodiments, the well tool further includes a first motor connected to the first portion of the shaft operable to rotate the first portion of the shaft. In some embodiments, the well tool further includes a second motor connected to the second portion of the shaft operable to rotate the second portion of the shaft. In some embodiments, the well tool further includes a third motor connected to the tool body, operable to rotate the tool body. In some embodiments, the first motor is connected to the second portion of the shaft and is operable to rotate the second portion of the shaft.

In some embodiments, the at least one slot of the housing is a radial slot.

In some embodiments, the at least one slot of the housing is an axial slot.

In certain aspects, a method includes rotating a shaft of a well tool in a first direction such that a first nut of a cutting device of the well tool translates axially along the shaft towards a second nut of the cutting device of the well tool arranged on the shaft, wherein the translation of the first nut towards the second nut extends multiple blades of the cutting device; and rotating the well tool to form a notch in a formation.

In some embodiments, the translation of the first nut towards the second nut extends a hinge of the cutting device, wherein the hinge connects a first blade of the multiple blades and a second blade of the multiple blades.

In some embodiments, the shaft is rotated by a first motor. In some embodiments, the well tool is rotated by a second motor. In some embodiments, the well tool is rotated by the first motor.

In some embodiments, a rotational speed of the well tool is greater than a rotational speed of the shaft.

In some embodiments, rotating a shaft of a well tool in a first direction and rotating the well tool to form a notch in a formation occur simultaneously.

In some embodiments, step rotating the well tool to form a notch in a formation comprises stopping the rotation of the shaft.

In some embodiments, the method further includes rotating the shaft in a second direction. In some embodiments, the rotation of the shaft in the second direction translates the first nut of the cutting device of the well tool axially along shaft away from the second nut arranged on the shaft. In some embodiments, the translation of the first nut away from the second nut retracts a blade hinge of the cutting device, wherein the blade hinge connects the first blade and the second blade.

The notching system for forming a notch in an open-hole wellbore includes a cutting device with a retracted position, an extended position, and a final position. The notch has predetermined dimensions that are achieved using the notching system. Fractures produced during fracturing may be generated at lower injection pressures due to the presence and dimensions of the notch. The cutting device is also able to control the depth to width ratio of the notch.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

A wellbore notching system includes a wellbore tool. The wellbore tool includes a cutting device having blades that cut a formation to form a notch in an open-hole (uncased) wellbore. The blades have a first position (retracted position), a second position (extended position), and a third position (final position). The blade positions are controlled by rotation of a shaft of the cutting device. In the retracted position, the blades are retained within an interior volume of a housing of the tool. In the extended position, the blades extend through the housing to engage with the formation. In the final position, the blades are fully extended and the notch in the formation is a final, predetermined size. The notching system can produce a variety of notch sizes and dimensions by controlling the angle and extension of the blades. The angle and extension of the blades is controlled by the cutting device and a controller.

Figure 1:
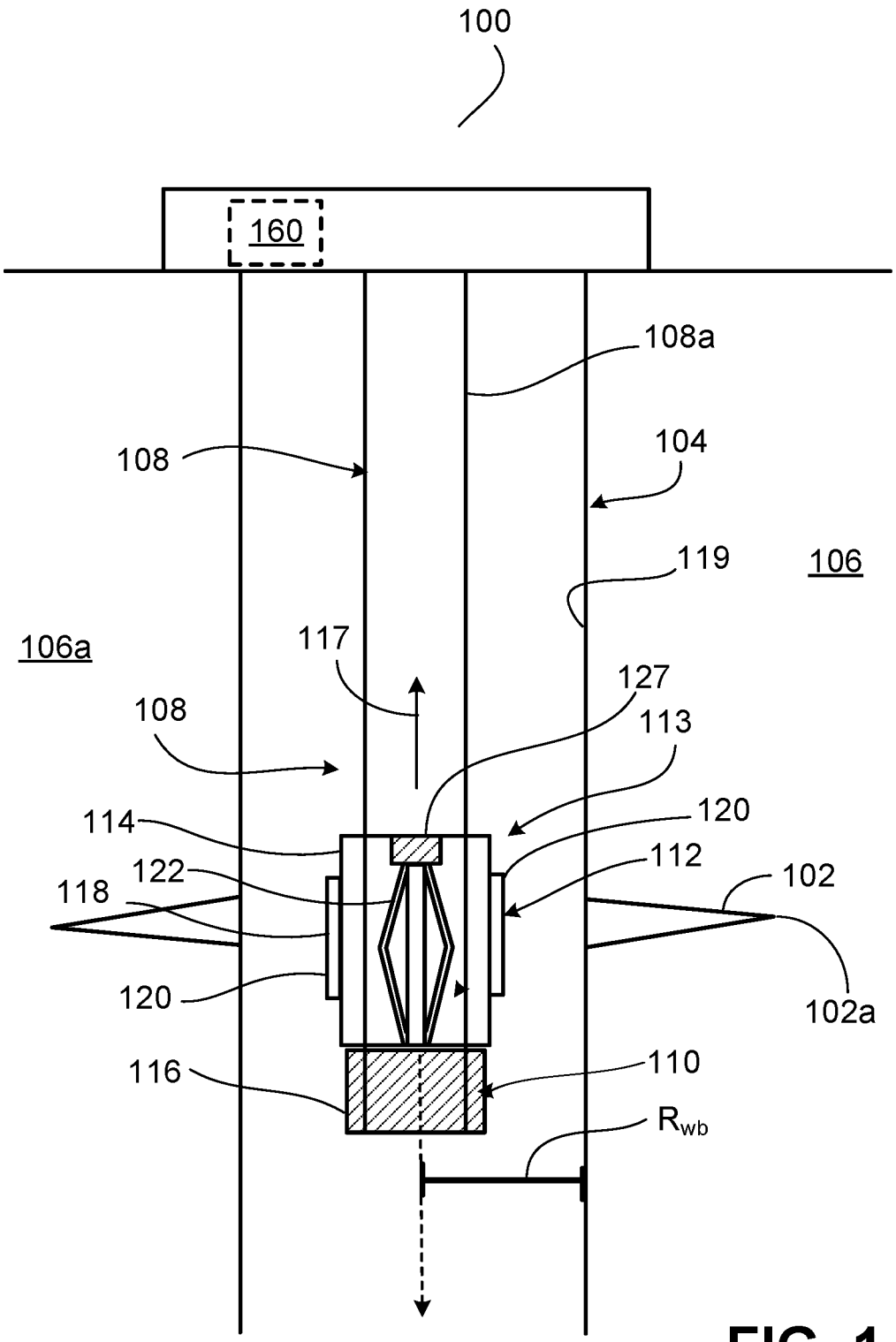
FIG. 1 is a view of a notching system having a well tool disposed in an open-hole wellbore.

FIG. 1 shows a wellbore notching system 100 for generating a notch 102 in a wellbore 104 surrounded by a formation 106. The system 100 includes a tubular body 108 that extends from the surface to a well tool 112, for example by a coiled tubing, deployed into the wellbore 104. A tool motor 110 (first motor) of a well tool 112 is operable to rotate the well tool in a first rotational direction or a second rotational direction opposite the first. The tool motor 110 anchors to the wellbore wall to enable steady rotation of the well tool 112 with respect to the wellbore. The tool motor may be hydraulically or electrically powered. In some systems, the well tool is an integral portion of the tubular body. In some systems, the second end is mounted to a second tubular body.

The wellbore has an axis 117 and the well tool 112 is centered on the axis 117. The wellbore 104 has a radius $R_{wb}$ measured from the axis 117 to a wall 119 of the wellbore 104. A penetration depth $D_n$ of the fully formed notch 102 is known prior to generating the notch 102. The penetration depth $D_n$ is measured from the wall 119 of the wellbore 104 to a tip 102*a* of the fully formed notch 102. The notch 102 also has predetermined final radius $R_{nfinal}$ measured from the axis 117 to the tip 102*a* of the fully formed notch 102. The dimensions of the notch 102 are described further with reference to FIG. 5.

The well tool 112 of the notching system 100 has a tool body 113 that that includes connection end 114 mounted to the tubular body 108 and a free end 116. The tool body 113 of the well tool 112 also includes a housing 118, centered on the axis 117, that has slots. The slots are arranged as axial slots 120 that extend from the first end 114 of the well tool 112 to the free end 116 of the well tool 112. The housing 118 also defines an interior volume 122 and a radius $R_h$ (FIG. 2) that is measured from the axis 117 to an edge the housing 118. The slots 120 align with blades of a cutting device.

Figure 2:
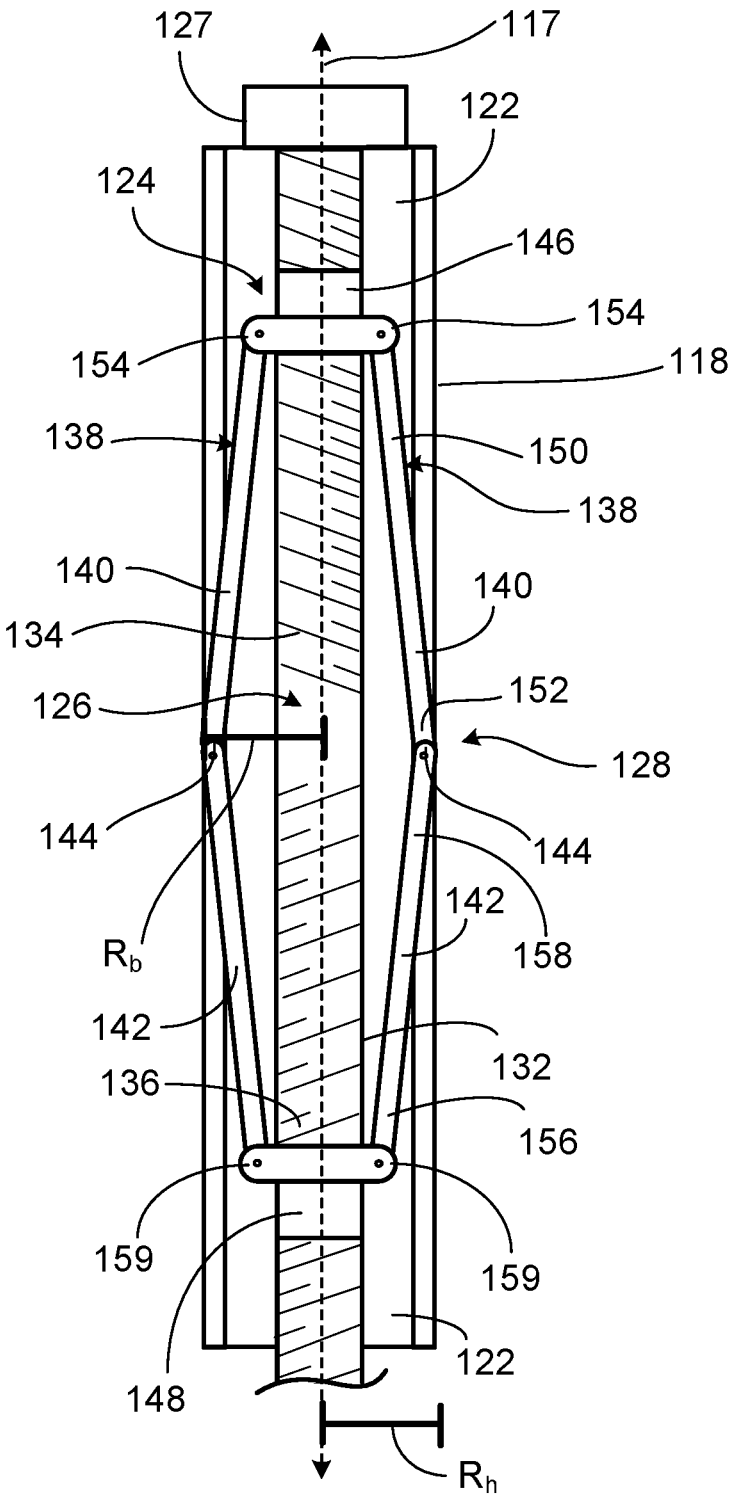
FIG. 2 is a cross-sectional side view of the well tool having a cutting device in a first retracted position.

FIG. 2 is a cross-sectional side view of a cutting device 124 of the well body 113 of the well tool 112 in a retracted position. The well tool 112 is arranged in the open-hole (uncased) wellbore 104. The cutting device 124 of the well tool 112 is arranged in the interior volume 122 of the housing 118. The cutting device 124 includes a shaft 126 disposed in the interior volume 122 of the housing, a shaft motor 127 (second motor) operable to rotate the shaft 126, and multiple blades 128 attached to the shaft 126. The shaft motor 127 and tool motor 110 may include signal transceivers that transmit and receive signals from a controller 160. Some controllers are arranged on the well tool. In some systems the controller adjusts the shaft motor to rotate the shaft to control extension of the blades based on pressures exerted on the multiple blades as they are dragged against the rock face during the notch cutting. In such a system, the multiple blades and/or the hinges have pressure sensors that transmit the pressure detected by the pressure sensors to the controller. The controller may then adjust the rotational speed and/or direction of the shaft motor to produce a smooth notch curvature.

In some implementations, the controller is a computer system that includes one or more processors and a computer-readable medium (for example, a non-transitory computer-readable medium) storing instructions executable by the one or more processors to perform operations described in this disclosure. In some implementations, the controller can include firmware, hardware, software, processing circuitry or any combination of them and configured to implement the operations described here.

The shaft 126 has a first portion 130 and a second portion 132. The first portion 130 includes a first exterior thread 134 that extends around the first portion 130 in a first helical direction (first pitch). The second portion 132 has a second exterior thread 136 that extends around the second portion 132 in a second helical direction (second pitch). The second helical direction is opposite the first helical direction. For example, the first helical direction (first pitch) may have a thread that is angled 45° relative to the axis 117. The second helical direction (second pitch) may have a thread that is angled −45° relative to the axis 117.

The multiple blades 128 include two blade sets 138 each aligned with a slot 120 of the housing 118. Each blade set 138 has a first blade 140, a second blade 142, and a blade hinge 144 connecting the first blade 140 to the second blade 142. A radius $R_b$ of the cutting device 124 is measured from the axis 117 to the blade hinge 144. The radius $R_b$ of the cutting device 124 increases or decreases as the blades of the cutting device 124 move into different positions.

The multiple blades 128 connect to the first portion 130 of the shaft 126 by a first nut 146. The multiple blades 128 connect to the second portion 132 of the shaft 126 by a second nut 148. The first nut 146 and second nut 148 each have a central threaded opening (not shown) that engages with the exterior threads 134, 136 of the first and second portions 130, 132 of the shaft 126, respectively.

The first blade 140 has a first end 150 and a second end 152. The first end 150 of the first blade 140 attaches to the first nut 146 by a connector 154, for example connection hinge or joint. The second end 152 of the first blade 140 connects to the blade hinge 144. The second blade 142 has a first end 156 and a second end 158. The first end 156 of the second blade 142 attaches to the second nut 148 by a connector 159, for example connection hinge or joint. The second end 154 of the second blade 142 connects to the blade hinge 144. The first blade 140 and second blade 142 are of equal length so that the blade hinge 144 is arranged equidistant from the first and second nuts 146, 148.

Figure 3:
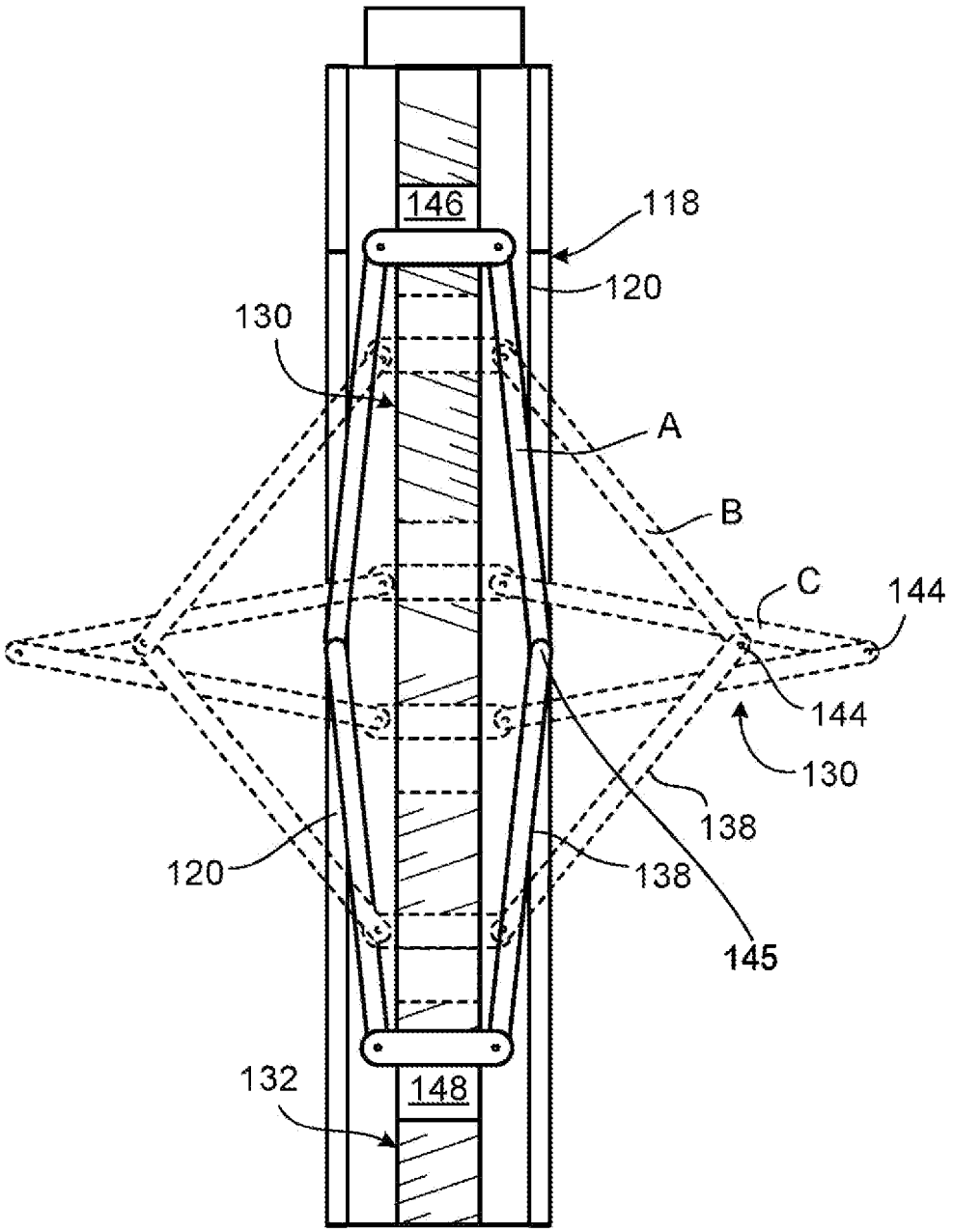
FIG. 3 is a cross-sectional side view of the cutting device of the well tool in the first retracted position, a second extended position, and a third final position.

Due to the first exterior thread 134 and second exterior thread 136 being oppositely angled, the rotation of the shaft 126 causes the first and second nuts 146, 148 to translate in opposite axial directions, increasing or decreasing the radius $R_b$ of the cutting device 124. For example, rotation of the shaft 126 in the first rotational direction axially translates the first nut 146 downhole and axially translates the second nut 148 uphole, increasing the radius $R_b$ of the cutting device 124. Rotation of the shaft in the second rotational direction axially translates the first nut 146 uphole and axially translates the second nut 148 downhole, decreasing the radius $R_b$ of the cutting device 124. As the first and second nuts 146, 148 translate axially along the shaft 126, the blade sets 138 flex or straighten about the blade hinge 144 to move cutting device 124 from the retracted position to the intermediate position, and onto to the final position, or vice versa FIG. 3 is a cross-sectional side view of the well tool 112 with the cutting device 124 in the retracted position (A), extended position (B), and final position (C). The cutting device 124 moves from the retracted position (A) to the extended position (B) and from the extended position (B) to the final position (C) by rotating the shaft in the first rotational direction (increasing the radius $R_b$ of the cutting device 124). The cutting device 124 moves from the final position (C) to the extended position (B) and from the intermediate position (B) to the retracted position (A) by rotating the shaft in the second rotational direction (decreasing the radius $R_b$ of the cutting device 124).

In the retracted position (A), the radius $R_b$ of the cutting device 124 is less than or equal to the radius $R_h$ of the housing 118. The blade sets 138, particularly the blade hinge 144, are arranged in the interior volume 122 of the housing 118. The cutting device 124 may be in the retracted position when transporting the well tool 112 into the wellbore 104 or removing the well tool 112 from the wellbore 104.

The shaft motor 127 rotates the shaft 126 in the first direction so that the first nut 146 translates downhole and the second nut 148 translates uphole. The translation of the first nut 146 moves the first end 150 of the first blade 140 downhole. The translation of the second nut 148 moves the first end 156 of the second blade 142 uphole. The blade hinge 144 moves radially outward due to the movement of the first ends 150, 156 towards each other, thereby increasing the radius $R_b$ of the cutting device 124. The cutting device 124 is now in the extended position (B).

In the extended position (B), the blade hinge 144 extends radially through the housing 118 via the axial slot 120 such that the radius $R_b$ of the blade is greater than the radius $R_h$ of the housing 118 but less than the final radius $R_{nfinal}$ of the notch 102. The shaft 126 continues to rotate until the blade sets 138 contact and begin to cut the formation 106 to form the notch 102. The blade hinge 144 first contacts the formation 106 and forms the tip 102*a* of the notch 102.

The shaft motor 127 continues to rotate the shaft 126 in the first direction so that the first nut 146 continues to translate downhole and the second nut 148 continues to translate uphole, extending the blade hinge 144 and second ends 152, 158 radially further into the forming notch 102 and increasing the radius $R_b$ of the cutting device 124. The desired shape of the notch 102 is known (predetermined) prior to operating the cutting device 124. The shaft 126 continues to rotate until the predetermined notch depth, shape, and any other notch dimensions are achieved. In the final position (C), the radius $R_b$ of the cutting device 124 is equal to or slightly less than the final notch radius $R_{nfinal}$.

Figure 4:
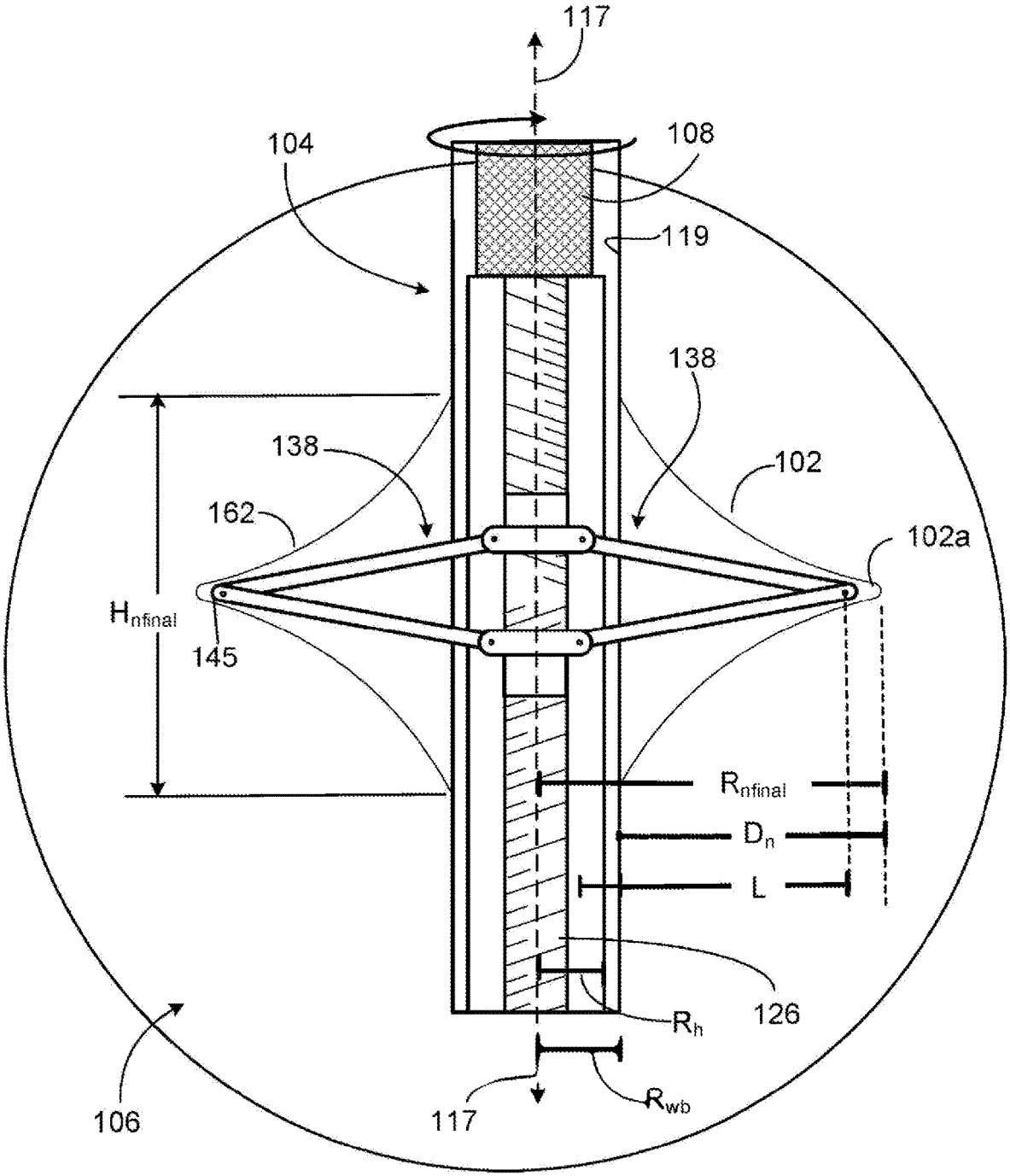
FIG. 4 is a side view of the well tool having the cutting device in the third position and a corresponding notch.

FIG. 4 is a cross-sectional side view of the well tool 112 with the cutting device 124 in the final position (C) and the formed notch 102. A curvature 162 of the notch 102 is controlled by the changing slope of the first and second blades 140, 142, which is controlled by the rotation of the shaft 126. The shaft motor 127 is controlled by the controller 160. The shaft motor 127 may be electronically or hydraulically triggered by the controller 160.

Figure 5A:
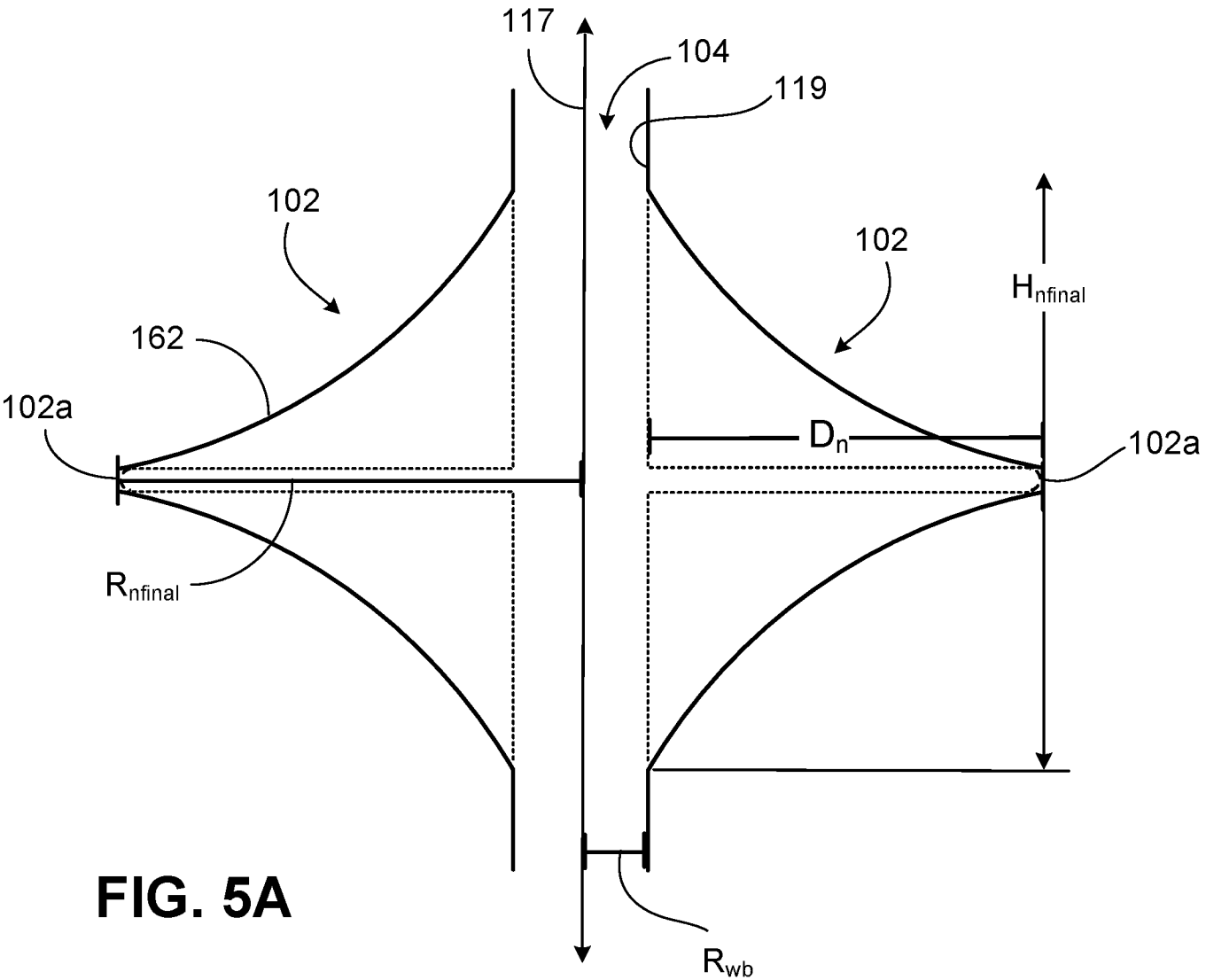
FIGS. 5A and 5B are a cross-sectional side views of the notch formed by the notching system.
Figure 5B:
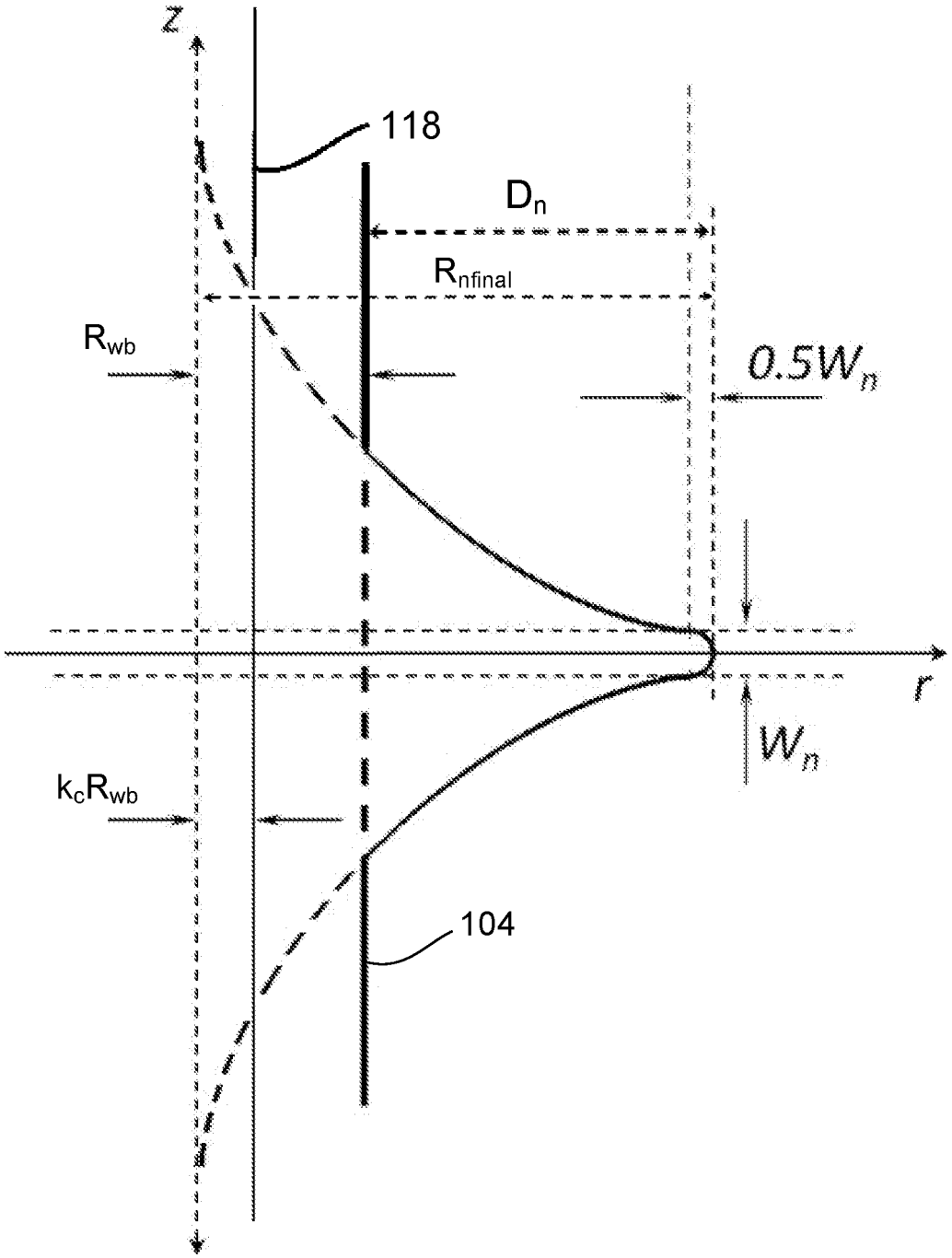

FIGS. 5A and 5B show a cross-sectional side view of the notch 102 in the wellbore 104 without the notching system 100. The controller 160 may increase or decrease the extension of the blades by rotating the shaft to produce a notch having a specific dimensions. FIG. 5B shows the resultant notch shape 162 may be determined analytically in cylindrical coordinates (r,z) with the axis z coinciding with the wellbore axis 117. Here the well tool 112 is centralized on the wellbore axis 117. In this analysis, the thickness of the blades 140, 142 is neglected as non-essential for the illustrational purposes in this disclosure. The hinges 154, 159 are translated axially at a fixed standoff from the well axis 117, $r=-k_cR_{wb}$, which is defined as a fraction of wellbore radius $R_{wb}$ via the coefficient $k_c$. By allowing parameter $k_c$ to change within $$-\frac{R_b}{R_{wb}} \le k_c \le \frac{R_b}{R_{wb}},$$

this standoff line can be located anywhere within the housing 118, so that the blades 140, 142 are connected to the nuts 146 and 148 using any connection known in the art. The specific case of $k_c=0$ corresponds to the blade hinges 154, 159 moving precisely along the wellbore axis 117. Distance L between the pairs of hinges 144, 154, 159 defines the effective blade length. It is assumed that having the blades in their final position (C) produces a round-ended notch with a tip 145 of small but finite width $W_n$. Then the tool blade length L is defined by the desired final notch radius $R_{nfinal}$, as follows:

$$L=k_cR_{wb}+R_{nfinal}-0.5W_n,$$

This particularly illustrates, that, geometrically, any final notch radius can be achieved by installing the blade of the known sufficient length into the cutting device 124.

Further, the curved face 162 of the notch is determined with the following equation:

$$|z(r)| = \begin{cases} 0.5W_n + L\left(1 - \left(\frac{r + k_c R_{wb}}{L}\right)^{2/3}\right)^{3/2}, & R_{wb} \le r < R_{nfinal} - 0.5W_n; \\ 0.5W_n\left(1 - \left(1 - \frac{R_{nfinal} - r}{0.5W_n}\right)^2\right)^{1/2}, & R_{nfinal} - 0.5W_n \le R_{nfinal} \end{cases}.$$

In particular, the final notch height $H_{nfinal}$ (i.e., opening of the notch at the wellbore wall) is $H_{nfinal}=2|z(R_w)|$ and becomes:

$$H_{nfinal} = 2R_{nfinal}\left(0.5\frac{W_n}{R_w}\frac{R_{wb}}{R_{nfinal}} + \frac{L}{R_{nfinal}}\left(1 - \left((1 + k_c)\frac{R_{wb}}{L}\right)^{2/3}\right)^{3/2}\right)$$

The opening height $H_{nfinal}$ of the notch 102 is larger as compared to a straight parallel face notch, due to the curvature 162. The larger opening height $H_{nfinal}$ reduces friction during further hydraulic fracture propagation stages that favor a lower fracturing pressure. To ensure initiation of transverse fracture, the notch 102 penetrates at least one wellbore diameter (double the wellbore radius $R_{wb}$) deep into the formation 106 such that the penetration depth $D_n=R_{nfinal}-R_{wb}$ $D_n=R_{nfinal}-R_w$ is equal to or greater than the diameter of the wellbore $D_{wb}=2R_{wb}$. To generate such a penetration depth $D_n$, the blade length L of the cutting device 124 is equal to or greater than one and half the wellbore diameter (triple the wellbore radius $R_{wb}$) for the case of $k_c=0$. $k_c=0$ In addition, a shorter opening height $H_{nfinal}$ reduces the amount of extracted rock. The ratio of the opening height $H_{nfinal}$ to notch penetration depth $D_n$ may be adjusted by using different blade length and varying standoff parameter $k_c$ with specific values assigned for the specific well case. For example, same final notch radius (penetration depth) can be achieved the using the shorter blade extracted to its final position (C), or by using longer blade in its extended position (B) only. In the latter case, the notch opening height is larger. In addition to that, notch opening can be reduced by off centering the standoff line for the hinges 154 and 159 towards the tool housing by increasing parameter $$k_c : k_c \to \frac{R_h}{R_w}.$$

Figure 6:
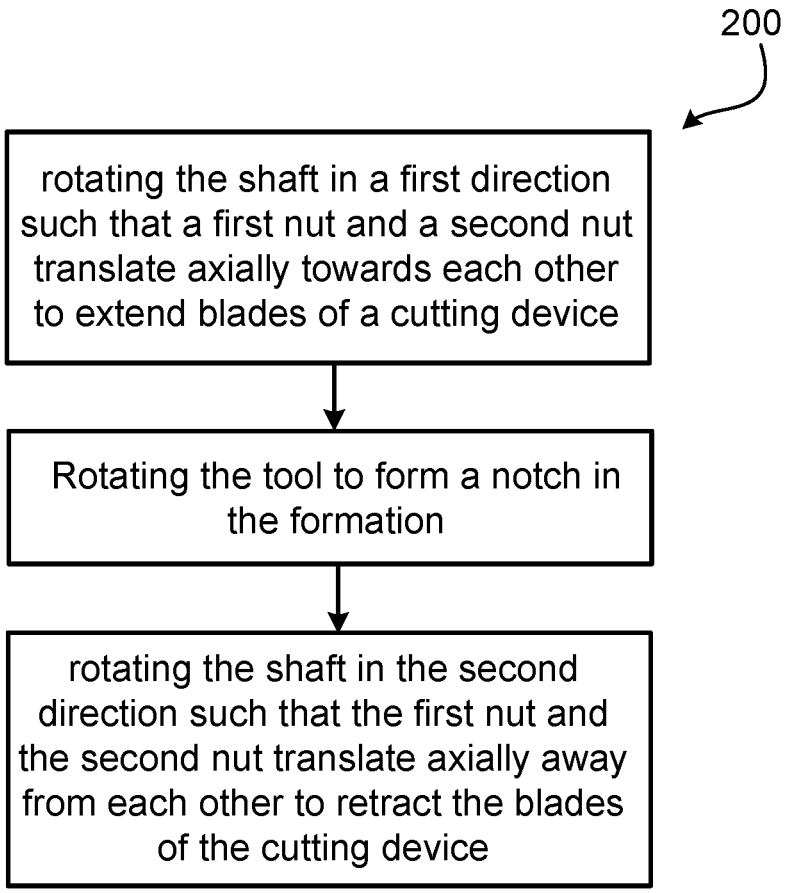
FIG. 6 is an example flowchart for a method generating a notch using the well tool.

FIG. 6 is an example flowchart of a method 200 for using a wellbore tool 112 to produce a notch of predetermined dimensions. The method 200 is described with reference to the wellbore notching system 100 but may be used with any other applicable system.

First, the well tool 112, mounted to the tubular body 108, is lowered into the wellbore 104 of the formation 106 a known depth until the cutting device 124 aligns with a portion of the wellbore 104 to be notched. The controller 160 may prompt the stopping of the translation of the well tool 112 and prompt the tool motor 110 to engage with the wellbore to anchor the well tool 102 at a specific location in the wellbore. The controller then signals for the shaft motor 127 to rotate the shaft 126 of the well tool 112 in a first direction so that the first nut 146 of a cutting device 124 translates axially along the shaft 126 towards the second nut 148 of the cutting device 124. The rotation of the shaft 126 by the shaft motor 127 in the first direction also translates the second nut 148 axially along the shaft 126, towards the first nut 146. The first and second nuts 146, 148 translate at the same speed because a first pitch of the first exterior thread 134 on the first portion 130 of the shaft 126 is equal to a second pitch of the second exterior thread 136 on the second portion 132 of the shaft 126. The translation of the first nut 146 towards the second nut 148 and the translation of the second nut 148 towards the first nut 146 extends the blade sets 138 of the cutting device 124, radially moving the hinge 144 outward and increasing the radius $R_b$ of the cutting device 124.

The rotation of the shaft 126 by the shaft motor 127 continues as blade hinges 144 of the cutting device 124 extend through the slots 120 of the housing 118 and the cutting device 124 moves from the retracted position to the extended position. The shaft motor 127 continues to rotate the shaft 126 until the hinges 144 contact the formation 106. At this stage, the radius $R_b$ of the cutting device 124 is equal to the radius $R_{wb}$ of the wellbore 104.

Next, the controller 160 signals to the tool motor 110 to rotate the well tool 112. The well tool 112 rotates and the notch 102 begins to form in the formation 106 due to the contact between the multiple blades 128 and the formation 106. Both the tool motor 110 and the shaft motor 127 rotate so that the multiple blades 128 continue to cut deeper into the formation 106 to form the notch 102. Both rotational speeds of the tool motor 110 and the shaft motor 127 are constant. In some methods, the rotation speeds of the tool motor may vary during the course of the method. In some methods, the rotation of the shaft motor to move the cutting device from the retracted position to the extended position and the rotation of the tool motor to move the well tool occurs simultaneously. In some methods, the controller may adjust the rotational speed and/or direction of the shaft motor to produce a smooth notch curvature. This adjustment may be made based on the pressure readings from pressure sensors installed on multiple blades and hinges as they are dragged against the rock face during the notch cutting. In this way, rotational speed of the shaft may be reduced in a response to the drag exerted on the blade exceeds the predefined limiting value; or may be increased in opposite case when drag is low.

The tool motor 110 and shaft motor 127 continue to rotate until the cutting device 124 has reached the final position (C) indicating that the notch 102 has achieved the predetermined opening height $H_{nfinal}$, penetration depth $D_n$, curvature 162, and radius $R_{nfinal}$. The distance that the radius $R_b$ of the cutting device 124 increases can be determined based on the number of turns of the shaft 126, counted by the shaft motor 127 or the controller 160. Therefore, in the method 200, the controller 160 determines the dimensions of the notch 102 based on the radius $R_b$ of the cutting device 124 and known rotational speed(s) of the shaft 127. In some systems, the radius $R_b$ of the cutting device can be calculated based on the nuts on the first and second portions of the shaft and the length of the first and second blades. In some methods, the notch 102 is measured or imaged to confirm that the predetermined dimensions are met. In some cases, reaching the predefined notch penetration depth may occur prior to the full extension of the blades.

Once the notch 102 dimensions have been confirmed and/or calculated, the controller prompts tool motor 110 to stop rotating the well tool 112 and prompts the shaft motor 127 to rotate in the second rotational direction. The rotation of the shaft motor 127 in the second rotational direction rotates the shaft 126 in the second rotational direction. Rotation of the shaft 126 in the second rotational direction translates the first nut 146 of the cutting device 124 axially along shaft 126, away from the second nut 148 arranged on the shaft 126. Rotation of the shaft 126 in the second rotational direction also translates the second nut 148 of the cutting device 124 axially along shaft 126, away from the first nut 146 arranged on the shaft 126. The movement of the first and second nuts 146, 148 away from each other retracts the blade hinge 144 and decreases the radius $R_b$ of the cutting device, moving the cutting device from the final position (C) to the extended position (B).

The shaft motor 127 continues to rotate in the second rotational direction as the radius $R_b$ of the cutting device 124 decreases and the multiple blades 128 are received by the slots 120 in the housing 118. The shaft motor 127 continues to rotate until the blade hinges 144 pass the axial slots 120 and the cutting device is in the retracted position (A). The well tool 112 is then removed from the wellbore 106 and further fracturing methods or procedures can be executed in the notched wellbore 106. In some methods, the downhole tool is moved to notch another section of the wellbore.

Figure 7:
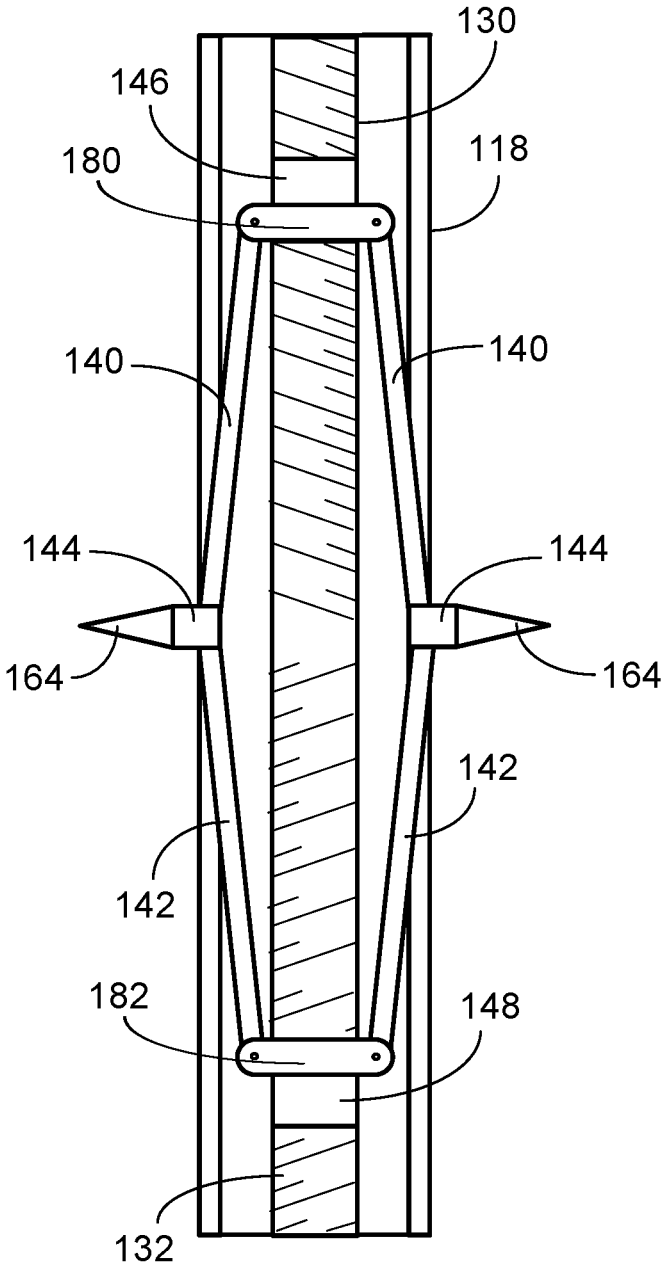
FIG. 7 is a cross-sectional side view of the well tool having a cutting device with a scribe.

FIG. 7 is a cross-sectional side view of the well tool 112 with a scribe 164. The scribe 164 is arranged on the blade hinge 144 and punctures the formation 106 in the extended position (B) of the cutting device 124. The scribe 164 sharpens the tip of the resulting notch 102 to increase stress concentration to form a transverse fracture. The scribe 164 is statically mounted to the blade hinge 144. In some systems, the scribe is arranged on a second axis, orthogonal to the axis 117. The scribe may rotate about or on the orthogonal axis.

In some systems, the first blade and second blade of the multiple blades are unequal in length.

In some systems, the first pitch of the first external thread of the shaft and the second pitch of the second external thread of the shaft are different. In some systems, the pitch of the first external thread is steeper than the pitch of the second external thread. In some systems, the pitch of the second external thread is steeper than the pitch of the first external thread.

In some systems, the pitches of the first and second external threads are varied. For example, the first external thread may have a steep pitch on a section of the thread that corresponds to the retracted position of the cutting device, but may have a flatter pitch in a section of the external thread that corresponds to the extended position. The second external pitch has the same varied pitch as the first external thread, in the extending opposite direction. For example, the second external thread may have a steep pitch on a section of the thread that corresponds to the retracted position of the cutting device, but may have a flatter pitch in a section of the external thread that corresponds to the extended position.

A wellbore notching system with a tool motor and a shaft motor has been described, however, some systems may only include a single tool motor attached to the shaft of the cutting device. In some embodiments, the first nut 146 includes a first lock 180 (FIG. 7) configured to lock the first nut in an axial position on the first portion of the shaft. The second nut also includes a second lock 182 (FIG. 7) configured to lock the second nut in an axial position on the second portion of the shaft. The housing of the tool body also has a lock to couple the housing to the shaft in a locked position. When the housing lock and locks 180, 182 of the first and second nuts are engaged or locked (engaged position), the tool body (the housing and the cutting device) are rotationally coupled to the shaft and tool motor. In this configuration, the multiple blades are locked into a position (e.g., retracted, extended, or final) and rotate with the motor to cut the formation (if in the extended). The housing also rotates with the multiple blades.

When the housing lock and locks of the first and second nuts are disengaged or unlocked (disengaged position), the tool body (the housing and the cutting device) are rotationally decoupled from the shaft and tool motor. For example, when the locks are disengaged, the tool motor rotates only the shaft. In this configuration, the housing is static, and the first and second nuts translate axially as the shaft rotates to move between the retracted, extended, or final position. In the disengaged position, the radius of the cutting device can increase or decrease as the shaft rotates.

The nut locks and the tool housing lock may be mechanical locks, magnetic locks, electric locks, or any combination thereof. The locks of the first and second nuts include elastic washers or springs that compress on the nut as the blades press against the formation.

Initially, the cutting device is in the retracted position, the locks of the first nut and second nut and the housing lock are unlocked. In this disengaged position the first and second nuts are free to rotate relative to the shaft. The tool motor rotates the shaft relative to the first nut, second nut, and the housing. In this way, the first and second nuts move along the first and second exterior threads, extending the blades. The nuts translate axially until the blades contact and press against the formation in the extended position. The contact between the formation and the blades compress the elastic washer locks. Under a predetermined amount of pressure from the contact between the formation and the blades, the elastic washer locks the first and second nut to the shaft. When the nut locks are engaged, the housing lock engages and the housing is rotationally coupled to the shaft and multiple blades. In this configuration, by rotating the shaft, the tool motor also rotates the housing and blades to cut the formation. As the formation is cut, the pressure between the blades and the formation lessens and the elastic washer or spring expands, unlocking the nuts from the shaft. This prompts the housing lock to also unlock. In this configuration, the tool motor continues to rotate the shaft relative to the first nut, second nut, multiple blades, and tool housing. The first and second nut again move axially along the shaft to further extend the blades. The locks on the nuts and housing lock continue to unlock and lock, as the cutting device deepens the notch in the formation. The first and second exterior threads may have a stop face at which the cutting device is in the final position and the nuts are rotationally coupled to the shaft. The notch is formed having predetermined dimensions.

The first and second portions of the shaft have been described as rotationally coupled, however, in some shafts, the first and second portions of the shaft are rotatable relative to each other. In such a system, the shaft has a rotational joint connecting the first portion of the shaft and the second portion of the shaft. In other systems, the first portion of the shaft and the second portion of the shaft are disconnected and are distanced from each other.

In some systems, the shaft motor may rotationally couple to the first portion of the shaft and a second shaft motor (third motor) may rotationally couple to the second portion of the shaft. The first shaft motor is operable to rotate the first portion of the shaft in the first and second rotational directions. The second shaft motor is operable to rotate the second portion of the shaft in the first and second rotational directions.

In some systems, the shaft motor is connected to the first portion of the shaft and the second portion of the shaft, rotatable relative to the first portion of the shaft. In such a system, the shaft motor is operable to rotate the second portion of the shaft, independent of the rotation of the first portion of the shaft.

Some tool include multiple cutting devices arranged axially within the interior volume of the housing. Such system form multiple transverse notches in the formation each using the multiple blades. Each cutting device may include a shaft, or the cutting devices may be arranged along an elongated shaft.

In some systems, the well tool is mounted on a drill string.

While a cutting device with two blade pairs has been described, some cutting devices may have more than two blade sets, for example four blade sets at increments of 90° around the shaft or six blade sets at increments of 60° around the shaft. In increased number of blade sets can result in a higher torque while reducing the load on individual blade pairs. Additional blade pairs may also centralize the tool during rotation and provide a smooth curvature.

A number of embodiments of the invention have been described. Nevertheless, it will be understood that various modifications may be made without departing from the spirit and scope of the invention. Accordingly, other embodiments are within the scope of the following claims.

What is claimed is:

1. A system for generating a notch in an open-hole wellbore, the system comprising:

a well tool comprising:

a tool body comprising:

a housing defining at least one slot, the housing defining an interior volume, the housing defining a longitudinal axis;

a cutting device disposed in the interior volume of the housing, the cutting device configured to form a notch in a formation through which the wellbore is formed, the cutting device comprising:

a shaft disposed in the interior volume of the housing, the shaft comprising:

a first portion having first exterior threads that extend around the first portion in a first direction, and a second portion having second exterior threads that extend around the second portion in a second direction, wherein the second direction is opposite the first direction; and multiple blades configured to form a round-ended notch, the multiple blades comprising:

a first blade extending from the first portion of the shaft, a second blade extending from the second portion of the shaft, and a blade hinge, wherein the first and second blade are attached by the blade hinge and form a tip of the multiple blades, wherein the tip has a radius, wherein the radius of the tip is parallel to the longitudinal axis of the housing, wherein the radius of the tip defines a curvature of a round end of the notch; and a motor rotationally coupled to the shaft of the cutting device; and a computer system comprising:

an electronic controller operatively connected to the motor; and one or more processors, a non-transitory computer-readable medium storing instructions executable by the one or more processors to perform operations, the operations comprising:

prompting the motor to rotate in a first direction;

calculating a radius of the cutting device, wherein the radius of the cutting device is perpendicular to the longitudinal axis of the housing;

comparing the calculated radius of the cutting device to a predetermined final radius; and prompting, in response to the comparison, the motor to rotate in a section direction, opposite the first direction.

2. The system according to claim 1, wherein the cutting device further comprises a first nut having a first threaded surface defining a first opening, wherein the first opening receives the first portion of the shaft.

3. The system according to claim 2, wherein the cutting device further comprises a second nut having a second threaded surface defining a second opening, wherein the second opening receives the second portion of the shaft.

4. The system according to claim 1, wherein the well tool has an extended position and a retracted position, wherein in the extended position, multiple blades extend through the slot of the housing, wherein in the retracted position the multiple blades are arranged in the interior volume of the housing.

5. The system according to claim 1, wherein the first blade attaches at a first end to the first portion of the shaft and the second blade attaches at a first end to the second portion of the shaft, wherein a second end of the first blade and a second end of the second blade attach at the blade hinge.

6. The system according to claim 5, wherein a first nut connects the first end of the first blade to the first portion of the shaft.

7. The system according to claim 5, wherein a second nut connects the first end of the second blade to the second portion of the shaft.

8. The system according to claim 1, wherein the blade hinge connects the first blade and the second blade.

9. The system according to claim 8, further comprising a scribe connected to the blade hinge of the cutting device.

10. The system according to claim 9, wherein the shaft defines a longitudinal axis, wherein the scribe is centered on and extends along a second axis, orthogonal to the longitudinal axis.

11. The system according to claim 10, wherein the scribe is configured to rotate on the second axis.

12. The system according to claim 1, wherein the at least one slot is multiple of slots, each slot of the multiple slots aligned with each blade of the multiple blades.

13. The system according to claim 1, wherein the motor is connected to the tool body operable to rotate the tool body.

14. The system according to claim 13, further comprising a second motor connected to the shaft operable to rotate the shaft.

15. The system according to claim 13, wherein the motor is connected to the shaft and is operable to rotate the shaft.

16. The system according to claim 1, wherein the motor is connected to the shaft operable to rotate the shaft and wherein the housing comprises a housing lock.

17. The system according to claim 16, wherein a first nut arranged on the first portion of the shaft comprises a first lock and a second nut arranged on the second portion of the shaft comprises a second lock.

18. The system to claim 1, wherein the first portion of the shaft is rotatable relative to the second portion of the shaft.

19. The system according to claim 18, further comprising a first motor connected to the first portion of the shaft operable to rotate the first portion of the shaft.

20. The system according to claim 19, further comprising a second motor connected to the second portion of the shaft operable to rotate the second portion of the shaft.

21. The system according to claim 20, further comprising a third motor connected to the tool body, operable to rotate the tool body.

22. The system according to claim 19, wherein the first motor is connected to the second portion of the shaft and is operable to rotate the second portion of the shaft.

23. The system according to claim 1, wherein the at least one slot of the housing is a radial slot.

24. The system according to claim 1, wherein the at least one slot of the housing is an axial slot.

25. A method comprising:

rotating a shaft of a well tool of a system in a first direction such that a first nut of a cutting device of the well tool translates axially along the shaft towards a second nut of the cutting device of the well tool arranged on the shaft, wherein the translation of the first nut towards the second nut extends multiple blades of the cutting device, wherein the well tool has a housing with a longitudinal axis, wherein the multiple blades are joined at a hinge with a width parallel to the longitudinal axis of the housing;

rotating the well tool to form a round-ended notch in a formation, wherein a round end of the round-ended notch has a radius of half the width of the hinge of the multiple blades;

calculating, by an electronic controller of a computer system of the system, a radius of the cutting device, wherein the radius of the cutting device is perpendicular to the longitudinal axis of the housing; and comparing, by the electronic controller of the computer system of the system, the calculated radius of the cutting device to a predetermined final radius.

26. The method according to claim 25, wherein the translation of the first nut towards the second nut extends the hinge of the cutting device, wherein the hinge connects a first blade of the multiple blades and a second blade of the multiple blades.

27. The method according to claim 25, wherein the shaft of the well tool is rotated by a first motor, wherein the well tool is rotated by a second motor.

28. The method according to claim 25, wherein the well tool is rotated by a motor.

29. The method according to claim 25, wherein a rotational speed of the well tool is greater than a rotational speed of the shaft.

30. The method according to claim 25, wherein rotating the shaft of the well tool in a first direction and rotating the well tool to form the notch in the formation occur simultaneously.

31. The method according to claim 25, further comprising rotating the shaft in a second direction.

32. The method according to claim 31, wherein the rotation of the shaft in the second direction translates the first nut of the cutting device of the well tool axially along shaft away from the second nut arranged on the shaft.

33. The method according to claim 32, wherein the multiple blades comprise a first blade and a second blade, wherein the translation of the first nut away from the second nut retracts the hinge of the cutting device, wherein the blade hinge connects the first blade and the second blade.

34. The method according to claim 25, wherein prior to rotating the shaft of the well tool in a first direction such that a first nut of the cutting device of the well tool translates axially along the shaft towards the second nut of the cutting device of the well tool arranged on the shaft, the method further comprises:

anchoring a tool body in a wellbore at an axial position in the wellbore.

* * * * *